US007232405B2

(12) United States Patent
Ko

(10) Patent No.: US 7,232,405 B2
(45) Date of Patent: Jun. 19, 2007

(54) TWISTER AND SIT-UP COMBINATION EXERCISER

(76) Inventor: Ming-Jen Ko, No. 92, Hsia Li Rd., Hsia Li Tsun, Changhua Hsien, Hsienhsi Hsiang (TW)

( * ) Notice: Subject to any disclaimer, the term of this patent is extended or adjusted under 35 U.S.C. 154(b) by 44 days.

(21) Appl. No.: 11/163,689

(22) Filed: Oct. 27, 2005

(65) Prior Publication Data

US 2007/0099778 A1 May 3, 2007

(51) Int. Cl.
*A63B 22/16* (2006.01)

(52) U.S. Cl. ..... 482/146; 482/140

(58) Field of Classification Search ..... 482/140, 482/907, 91, 146–147, 34; D21/687–689
See application file for complete search history.

(56) References Cited

U.S. PATENT DOCUMENTS 4,396,189 A * 8/1983 Jenkins ..... 482/71
5,310,395 A * 5/1994 Ko ..... 482/146
5,527,253 A * 6/1996 Wilkinson et al. ..... 482/147
5,632,711 A * 5/1997 Hwang ..... 482/147
5,697,874 A * 12/1997 Abelbeck ..... 482/140
5,725,463 A * 3/1998 Colonello et al. ..... 482/140
5,752,901 A * 5/1998 Lee ..... 482/130
5,772,562 A * 6/1998 Stevens ..... 482/140
5,772,563 A * 6/1998 Lin ..... 482/140
5,776,042 A * 7/1998 Szabo ..... 482/140
5,779,607 A * 7/1998 Harris ..... 482/140
5,807,220 A * 9/1998 Allis et al. ..... 482/140
5,810,702 A * 9/1998 Wilkinson ..... 482/142
5,813,957 A * 9/1998 Rossiter ..... 482/140
5,816,985 A * 10/1998 Ho ..... 482/140
5,853,357 A * 12/1998 Jones, Jr. ..... 482/140
5,863,280 A * 1/1999 Wang ..... 482/140
5,882,284 A * 3/1999 Cayne ..... 482/130
6,428,450 B1 * 8/2002 Ho et al. ..... 482/140
6,440,045 B1 * 8/2002 Gaston ..... 482/140
7,074,167 B1 * 7/2006 Chen ..... 482/146
2003/0100415 A1 * 5/2003 Augustine et al. ..... 482/140
2004/0053757 A1 * 3/2004 Chung ..... 482/140
2005/0049116 A1 * 3/2005 Huang ..... 482/51
2006/0068979 A1 * 3/2006 Hsieh ..... 482/140

* cited by examiner

*Primary Examiner*—Lori Amerson
(74) *Attorney, Agent, or Firm*—Alan Kamrath; Kamrath & Associates PA

(57) ABSTRACT

A twister and sit-up combination exerciser has a base, two V-shaped levers each having a front end with a grip and a read end, a supporting frame adjustably attached to the rear ends of the levers, and at least one twister rotatably mounted on the base. The two V-shaped levers are pivotally attached to the base to provide a sit-up auxiliary structure. By combining the twister with the sit-up auxiliary structure, the exerciser has at least two functions. Moreover, the base further has a base twister rotatably attached under the base to make the exerciser have more versatility in use.

16 Claims, 14 Drawing Sheets

TWISTER AND SIT-UP COMBINATION EXERCISER

BACKGROUND OF THE INVENTION

1. Field of the Invention

The present invention relates to an exerciser, and more particularly to an exerciser that has not only sit-up-type operation but also twister-type operation to make the exerciser versatile in use.

2. Description of Related Art

People in modern times pay much attention to their health and to keep their bodies in good shape by stressing particular portions. For abdominal muscles, sit-up is a common method to train the abdominal muscles without auxiliary, however, a user may have injury to the waist or the spine because of over-stress, inaccurate movement, distraction or insufficient strength during operation. Moreover, having the sit-up exercise without auxiliary easily causes overload and intolerable ache to the abdominal muscles and even sport injury as mentioned before so that a user would be reluctant to have the sit-up exercise. Therefore, few exercisers for training abdominal muscle have been invented to prevent the foregoing problems.

With reference to FIG. 1, a conventional auxiliary exerciser for sit-up comprising a movable frame 10, a stationary frame 20 and two pivotal assemblies 30.

The moveable frame 10 is a U-shaped frame with two distal ends, bent to perform a V-shaped cross-sectional side view and pivotally connected to the stationary frame 20 by the pivotal assemblies 30. The movable frame 10 has a close end, a cushion 101 attached to a middle section of the close end and two distal ends each having a grip 102. The stationary frame 20 is U-shaped and has two ends pivotally and respectively attached to two sides of the movable frame 10 at apexes in the V-shaped cross-sectional side view, and has a pad 201 mounted on the stationary frame 20. Thereby, the user enables to lie on the exerciser, sit the hip on the pad 201, rest the neck on the cushion 101 and hold the grips 102 to practice the sit-up exercise easily and safely by having support at the neck.

However, the auxiliary exerciser only has single function for practicing the sit-up exerciser that only trains the abdominal muscles so that the user may feel bored soon and leave the exerciser unused.

SUMMARY OF THE INVENTION

To overcome the drawbacks of the conventional auxiliary exerciser for sit-up, a twister and sit-up combination exerciser is provided to eliminate the drawbacks.

A main objective of the present invention is to provide a twister and sit-up combination exerciser that has versatile uses including waist twisting, body twisting and sit-up exercise to increase utility of the exerciser.

Another objective of the present invention is to provide a twister and sit-up combination exerciser that has an adjustable supporting frame to satisfy different users in different sizes to increase adaptation and convenience of the exerciser.

To achieve the foregoing objective, the twister and sit-up combination exerciser comprises:

a base;

two V-shaped movable levers pivotally and respectively attached to two sides of the base, wherein each V-shaped movable lever has a front section with a grip portion bending inward, a rear section being straight and a joint of the front section and the rear section to attach the base by a pivotal assembly;

a supporting frame being U-shaped, having two distal ends and telescoping to the rear sections of the two movable levers with the two distal ends to serve as a backrest; and a twister assembly mounted on the base, wherein the twister assembly comprises an intermediate plate rotatably attached to the base and a rotating disk rotatably clamping the intermediate plate with the base.

By combining the twister assembly with the base having two movable levers, the exerciser has multiple operations such as sit-up, waist-twisting and body-twisting etc. to make the exerciser versatile in use. Additionally, the supporting frame 7 is adjustable to make the backrest changeable in length to satisfy different users.

Further benefits and advantages of the present invention will become apparent after a careful reading of the detailed description with appropriate reference to the accompanying drawings.

DETAILED DESCRIPTION OF THE PREFERRED EMBODIMENT

Figure 1:
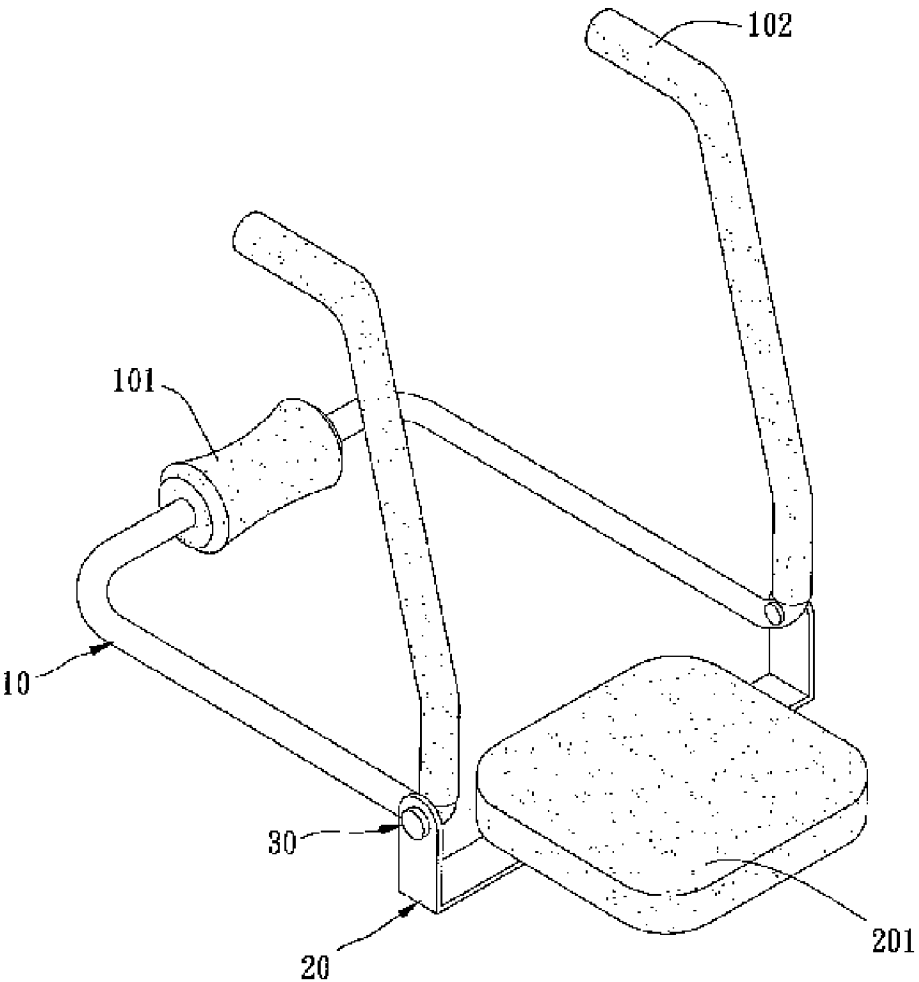
FIG. 1 is a perspective view of a conventional auxiliary exerciser for sit-up in accordance with the prior art.
Figure 2:
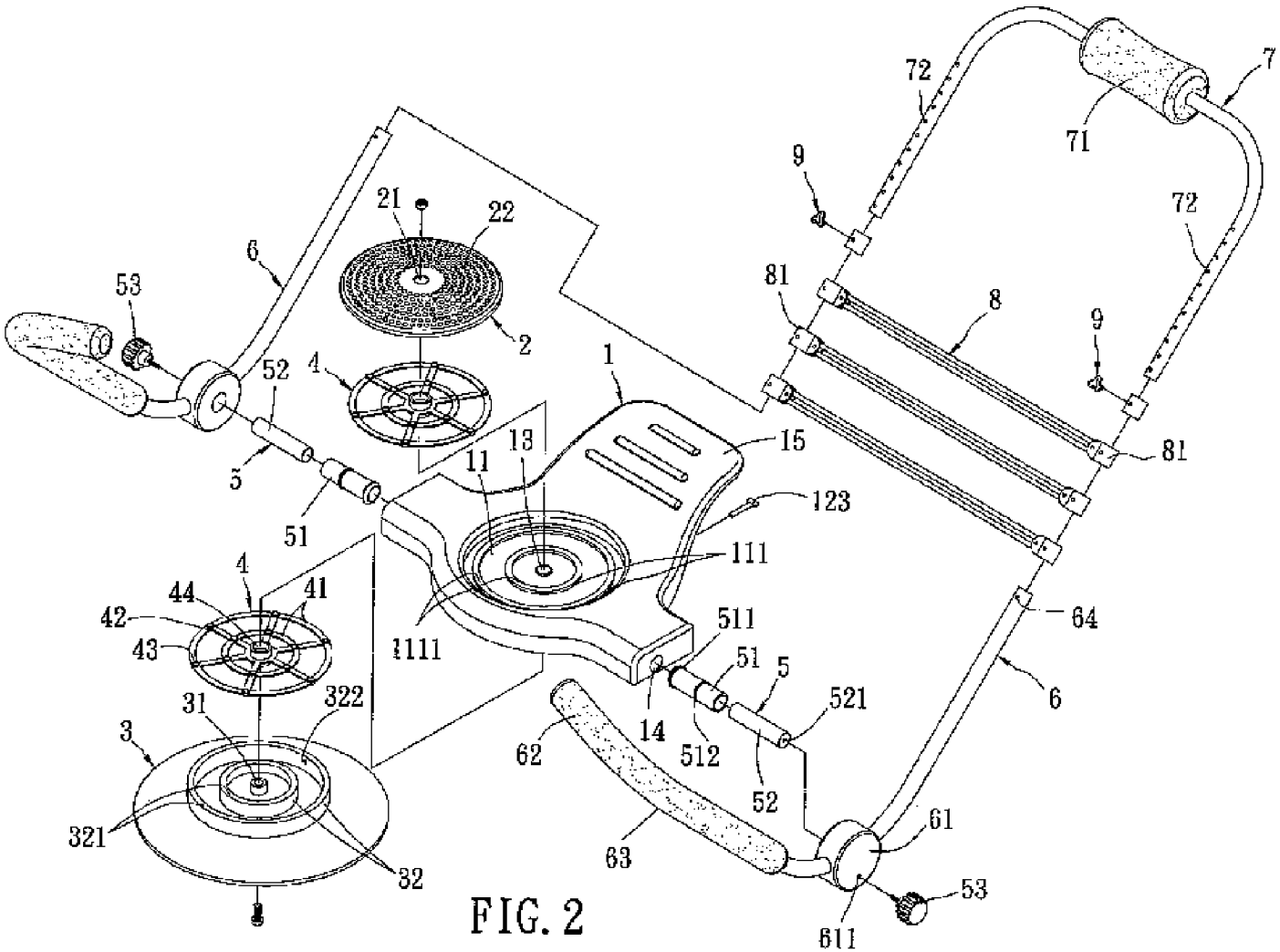
FIG. 2 is an exploded perspective view of a preferred embodiment of a twister and sit-up combination exerciser in accordance with the present invention.

A twister and sit-up combination exerciser in accordance with the present invention comprises a base, two V-shaped levers each having a front end and a read end, a supporting frame adjustably attached to the rear ends of the levers and a twister assembly rotatably mounted on the base. The two V-shaped levers are pivotally and oppositely attached to the base to provide a sit-up auxiliary structure. By combining the twister assembly with the sit-up auxiliary structure, the exerciser has at least two functions. Moreover, the base further has a bottom twister rotatably attached under the base to make the exerciser have more versatility in use.

With particular reference to FIGS. 2 to 5, a preferred embodiment of the twister and sit-up combination exerciser comprises a base 1, a top rotating disk 2, a bottom rotating disk 3, two intermediate plates 4, two pivotal assemblies 5, two movable levers 6, a supporting frame 7 and multiple optional resilient ropes 8. Wherein, each twister assembly is composed of one intermediate plate and a rotating disk.

Figure 3:
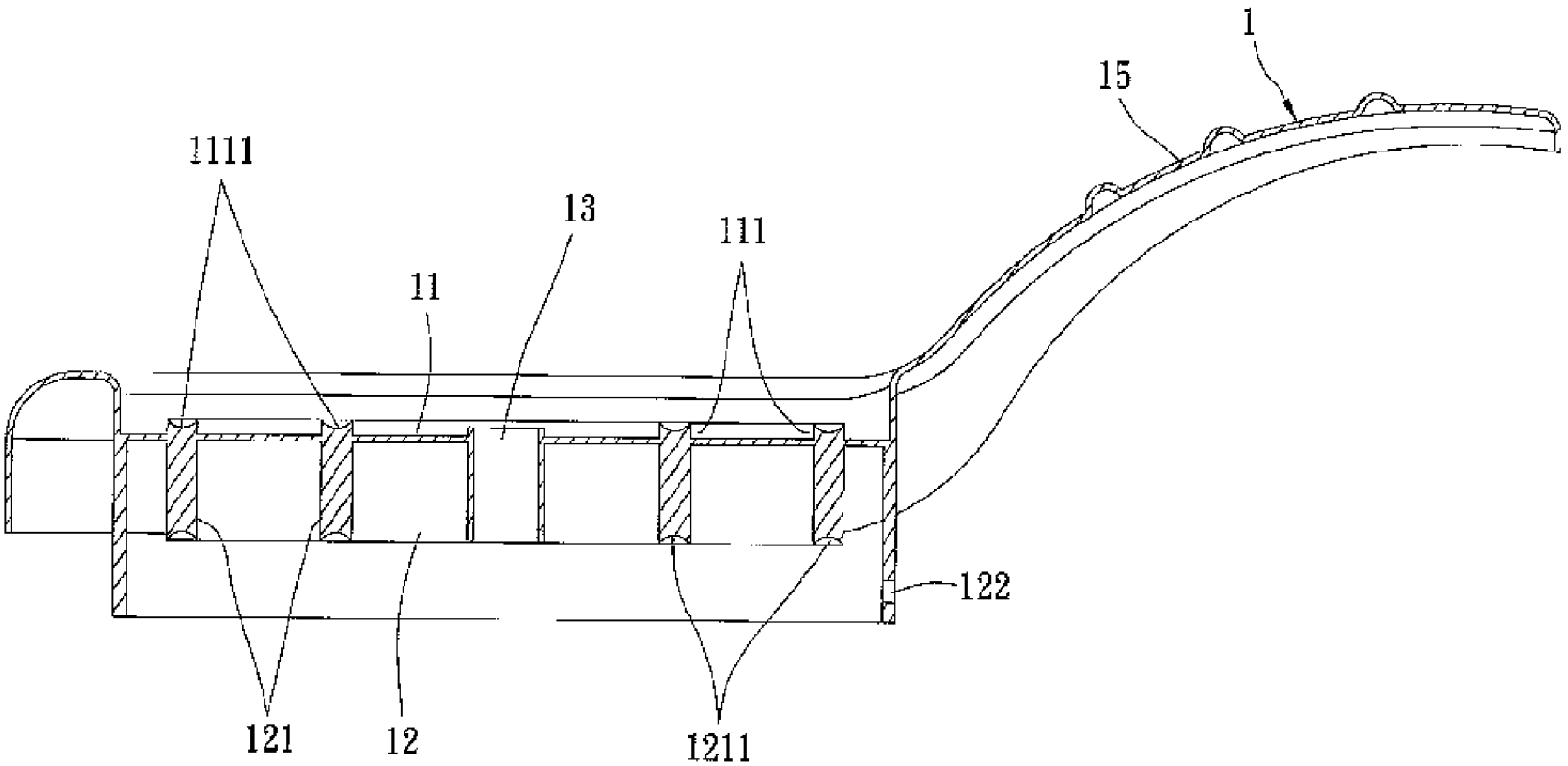
FIG. 3 is a cross-sectional side view of a base in the exerciser in FIG. 2.
Figure 4:
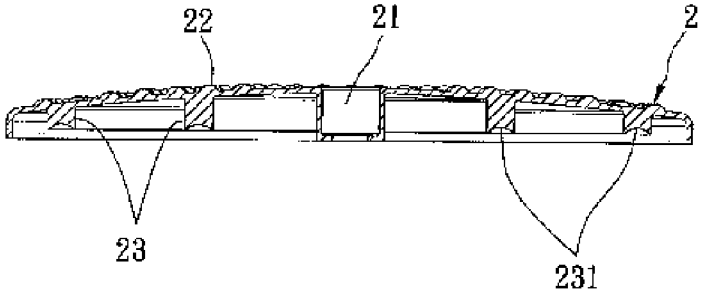
FIG. 4 is a cross-sectional side view of a top plate in the exerciser in FIG. 2.

The base 1 is substantially flat body and has a top face, a bottom face, two side edges, a tail portion 15 and two disk recesses 11, 12. The tail portion 15 extends from the flat body to incline upwardly and the two disk recesses 11, 12 are respectively defined in the top face and bottom face of the base 1. Each disk recess 11, 12 has a bottom, a through hole 13 defined in a center of the bottom and two circular ribs 111, 112 concentrically formed on the bottom, wherein each circular rib 111, 112 has a top groove 1111, 1211. The disk recess 12 on the bottom face of the base 1 has a pin hole 122 defined through a side of the disk recess 12 as shown in FIG. 3. The base 1 further has two insert holes 14 respectively defined in the two side edges.

As shown in FIG. 3, the top rotating disk 2 has a top face, a bottom face, a sunken hole 21 defined in a center of the top face and multiple massage stubs 22 formed on the top face as well. The top rotating disk 2 further has two circular ribs 23 concentrically formed on the bottom face of the top rotating disk 2, wherein each circular rib 23 has a top groove 231.

Figure 5:
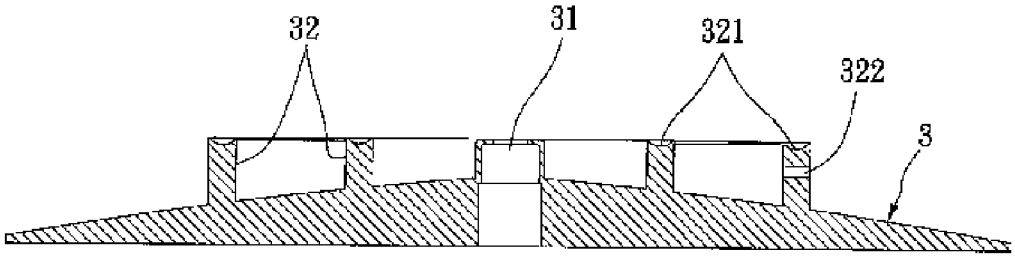
FIG. 5 is a cross-sectional side view of a bottom plate in the exerciser in FIG. 2.

As shown in FIG. 5, the bottom rotating disk 3 is a pedestal setting on the ground and also has a top face, a sunken hole 31 defined in a center of the top face and two circular ribs 32 concentrically formed on the top face, wherein each circular rib 32 has a top groove 321. Particularly, a pin hole 322 is defined in an outer one of the two circular ribs 32.

Each intermediate plate 4 is a round disk and has an abutting face, two circular ribs 41 concentrically formed on the abutting face, multiple straight ribs 42 radially formed on the abutting face, and multiple rolling balls 43 rotatably attached at intersections of the circular flanges 41 and the straight ribs 42. The intermediate plate 4 further has an axial hole 44 defined in a center of the abutting face.

Each pivotal assembly 5 is composed of a sleeve 51, a shaft 52, and a manual bolt 53. The sleeve 51 is tubular and has a tapered rim 511 formed on an end adjacent to the base 1 and a stop flange 512 formed on a middle portion of the sleeve 51. The shaft 52 has threaded hole 521 axially defined at one end adjacent to the movable lever 6.

Each movable lever 6 is V-shaped and has a front section, a rear section and a pivotal base 61 with a pivotal hole 611 attached to a joint of the front and rear sections. The front section is bent inwardly to serve as a grip portion 62 and has a resilient sleeving body 63 attached to the grip portion 62. The rear section has a locking hole 64 defined near a distal end of the movable lever 6.

The supporting frame 7 is substantially U-shaped and has two arms, a middle section between the two arms, a soft cushion 71 mounted on the middle section. Each of the two arms of the supporting frame 7 has multiple positioning holes 72 defined in line to selectively align with the locking hole 62 on the corresponding movable lever 6. The multiple resilient ropes 8 extends between the two arms of the supporting frame 7 and each resilient rope 8 has two ends and two fastening sleeve 81 respective attached to the two ends to detachably mount on the arms.

Figure 6:
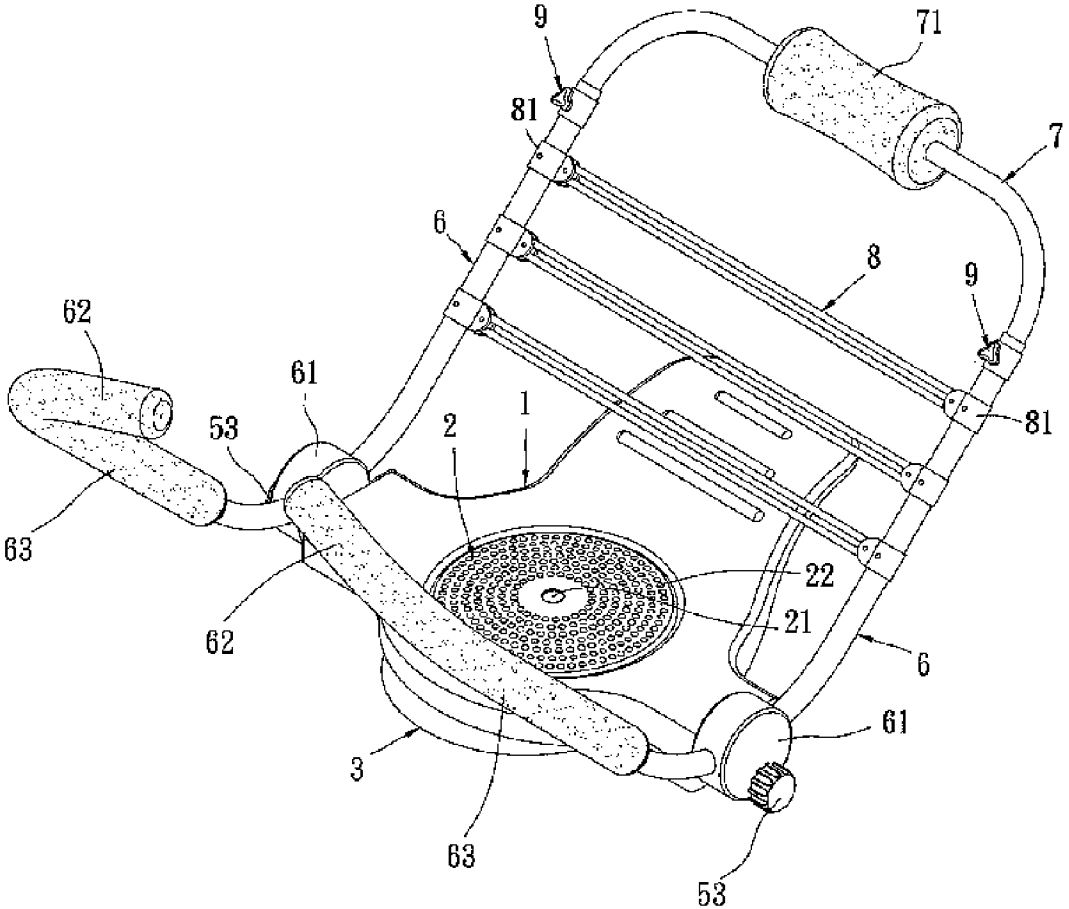
FIG. 6 is a perspective view of the exerciser in FIG. 2, wherein the exerciser is assembled.

Moreover, with reference to FIG. 6, the exerciser of the present invention in assembly is shown. When the exerciser is combined, the top rotating disk 2 and the bottom rotating disk 3 are respectively received inside the disk recess 11, 12 on the top and bottom faces of the base 1 to respectively clamp the two intermediate plates 4 with the base 1. Thereby, the rolling balls 43 on the intermediate plates 4 are received in the top grooves 1111, 1211 on the circular ribs 111, 121 of the base 1 and the corresponding top groove 231, 321 on the circular ribs 23, 32 on the top rotating disk 2 or the bottom rotating disk 3 to make the base 1 and the top rotating disk 2 rotatable. Then, a bolt (not numbered) penetrates the sunken hole 31 of the bottom rotating disk 3, the axial hole 44 of one intermediate plate 4 adjacent the bottom rotating disk 3, the through hole 13 of the base 1, the axial hole 44 of another intermediate plate 4, and the sunken hole 21 of the top rotating disk 2 in sequence and engages a nut (not numbered) to rotatably combine top rotating disk 2 and the bottom rotating disk 3 to the base 1.

Additionally, each pivotal assembly 5 rotatably attaches to the base 1 by engaging the tapered rim 511 of the sleeve 51 with the corresponding insert hole 14 on the base 1 and abutting the stop flange 512 to edge of the insert hole 14 to keep the sleeve 51 stay on the base 1. The shaft 52 is rotatably retained inside the sleeve 51 and a corresponding movable lever 6 is engaged to the pivotal assembly 5 by penetrating pivotal hole 611 on the pivotal base 61 with a manual bolt 53 to engage the threaded hole 521 on the shaft 52. Thereby, the two movable levers 6 are rotatably combined to the base 1. Then, the resilient ropes 8 are mounted on the supporting frame 7 by attaching the fastening sleeves 81 on the arms of the supporting frame 7. Lastly, the two arms of the supporting frame 7 telescope with the rear section of the movable lever 6 and combine with the movable lever 6 by inserting a locking element 9 through the locking hole 64 on the movable lever 6 and one corresponding positioning hole 72 on the supporting frame 7. Thereby, the exerciser is achieved.

Figure 7:
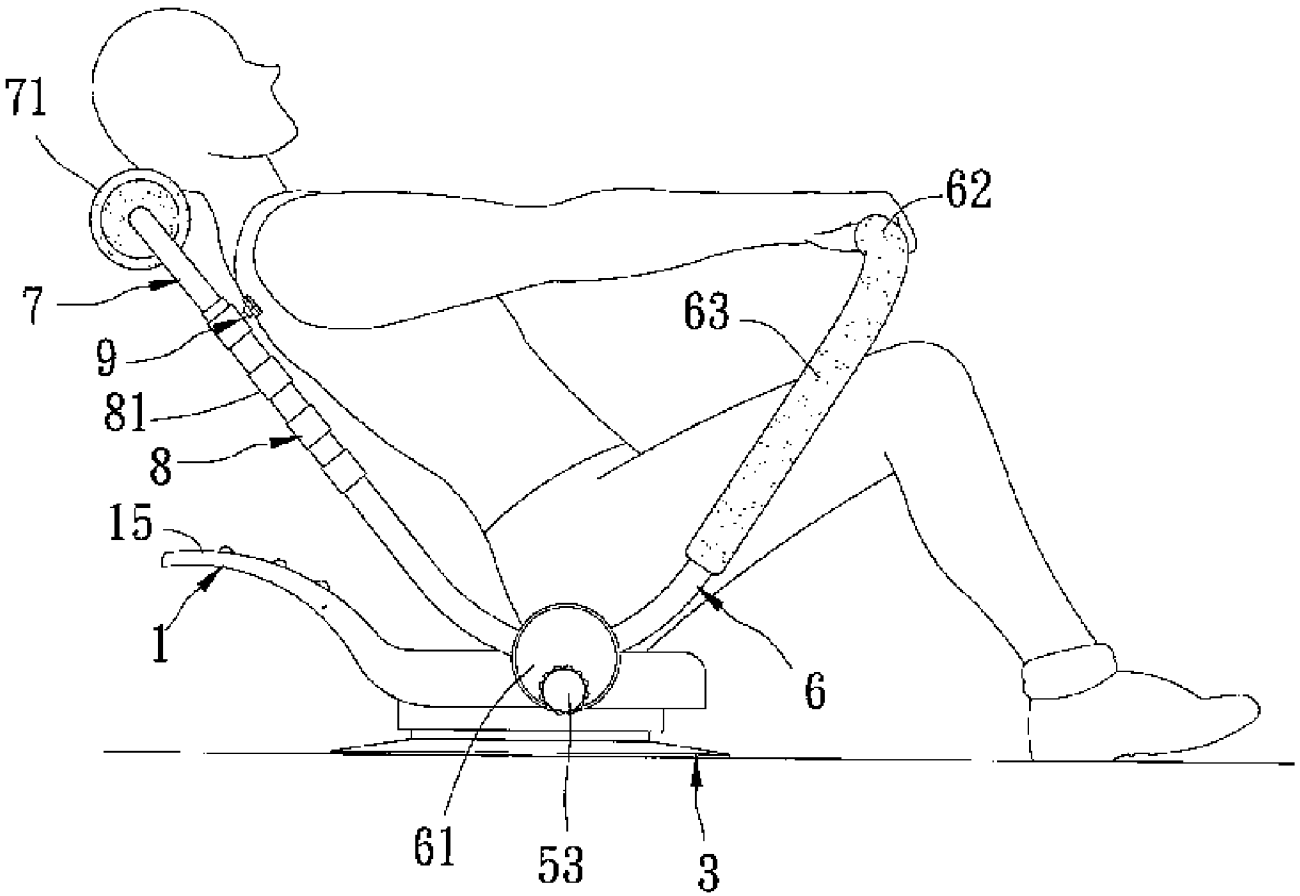
FIG. 7 is an operational view of practicing sit-up exercise with the exerciser in the present invention.
Figure 8:
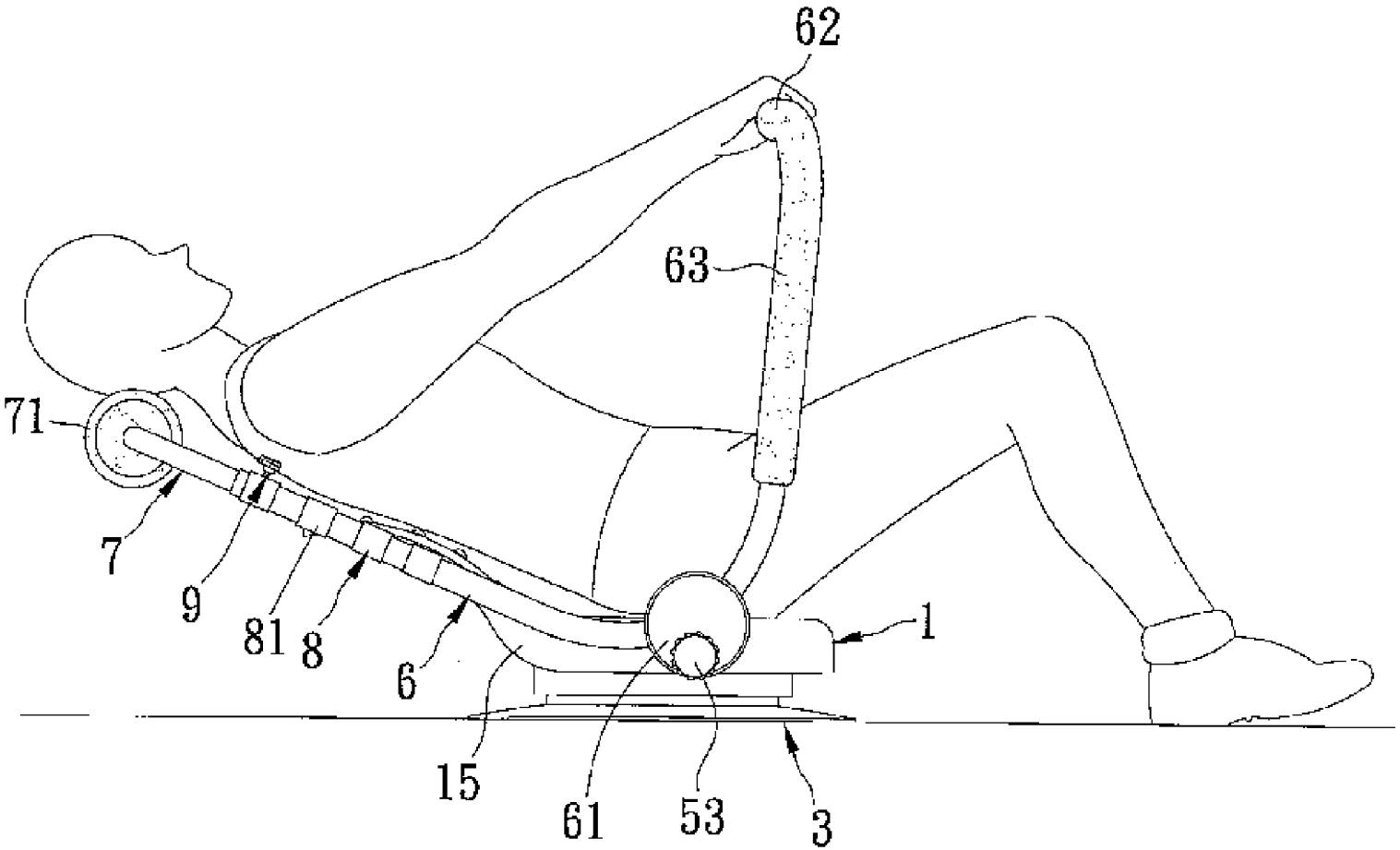
FIG. 8 is another operational view of practicing the sit-up exercise with the exerciser in the present invention.

When the exerciser operates, as shown in FIGS. 7 and 8, the user sits on the top rotating disk 2 mounted on the base 1, rests the back on the resilient ropes 8 and the soft cushion 71 on the supporting frame 7 to perform a reclining position, and holds the resilient sleeving bodies 63 on the grip portions 62 with hands. Therefore, the user enables to practice sit-up exercise with the supporting efficiency provided by the supporting frame 7 so that overloads to the back and the neck are obviated and injury is correspondingly reduced.

Figure 9:
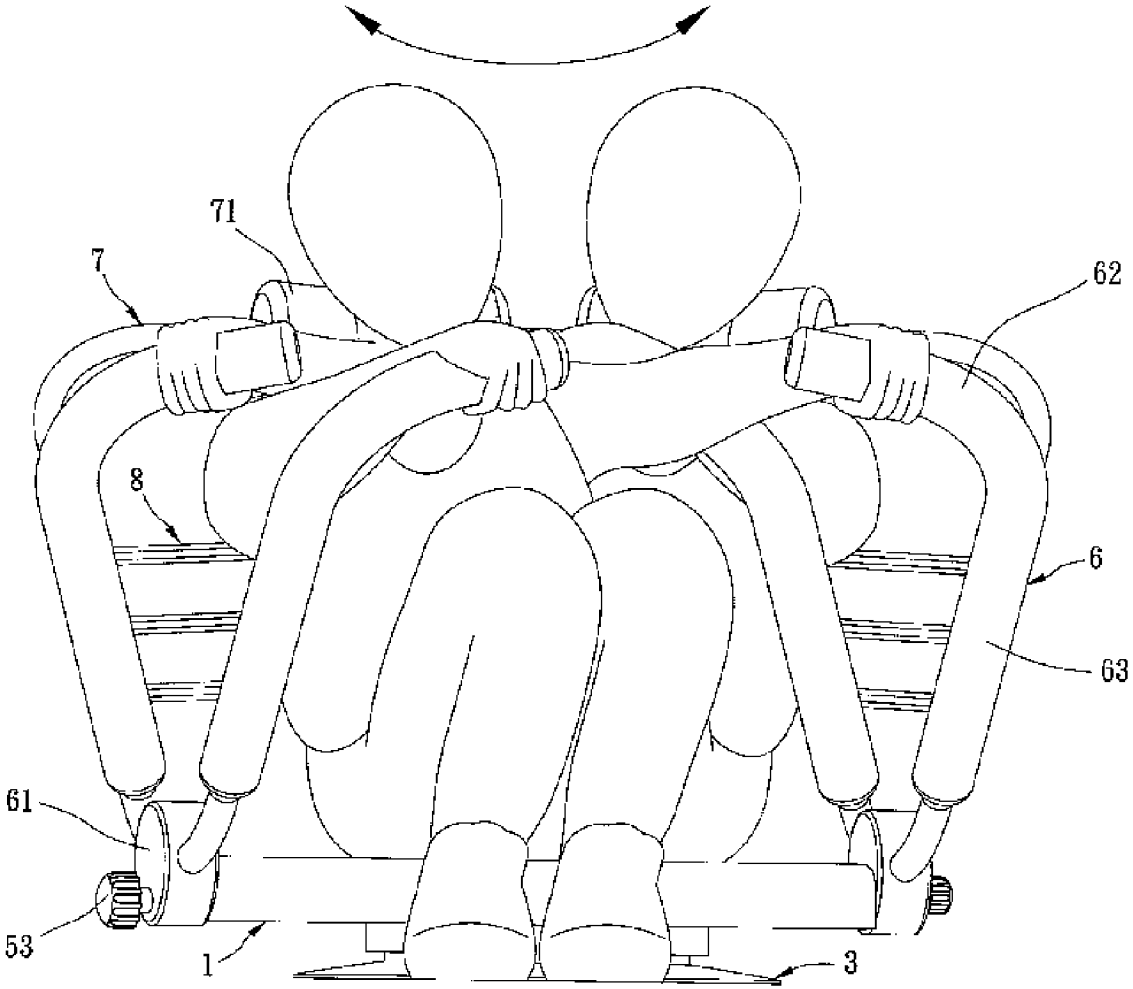
FIG. 9 is an operational front view of practicing waist-twisting and body-twisting exercises with the exerciser in the present invention.

With reference to FIG. 9, another operation of the exerciser in the present invention is provided, wherein the user sits on the top rotating disk 2, reclines on the supporting frame 7, holds the resilient sleeving body 63, and retracts the feet to put on the ground. Because the base 1 is rotatable on the bottom rotating disk 3, the user enables to twist the waist and the upper body by driving the base 1 to rotate so that the exerciser can selectively train the waist and the back in this operation.

Figure 10:
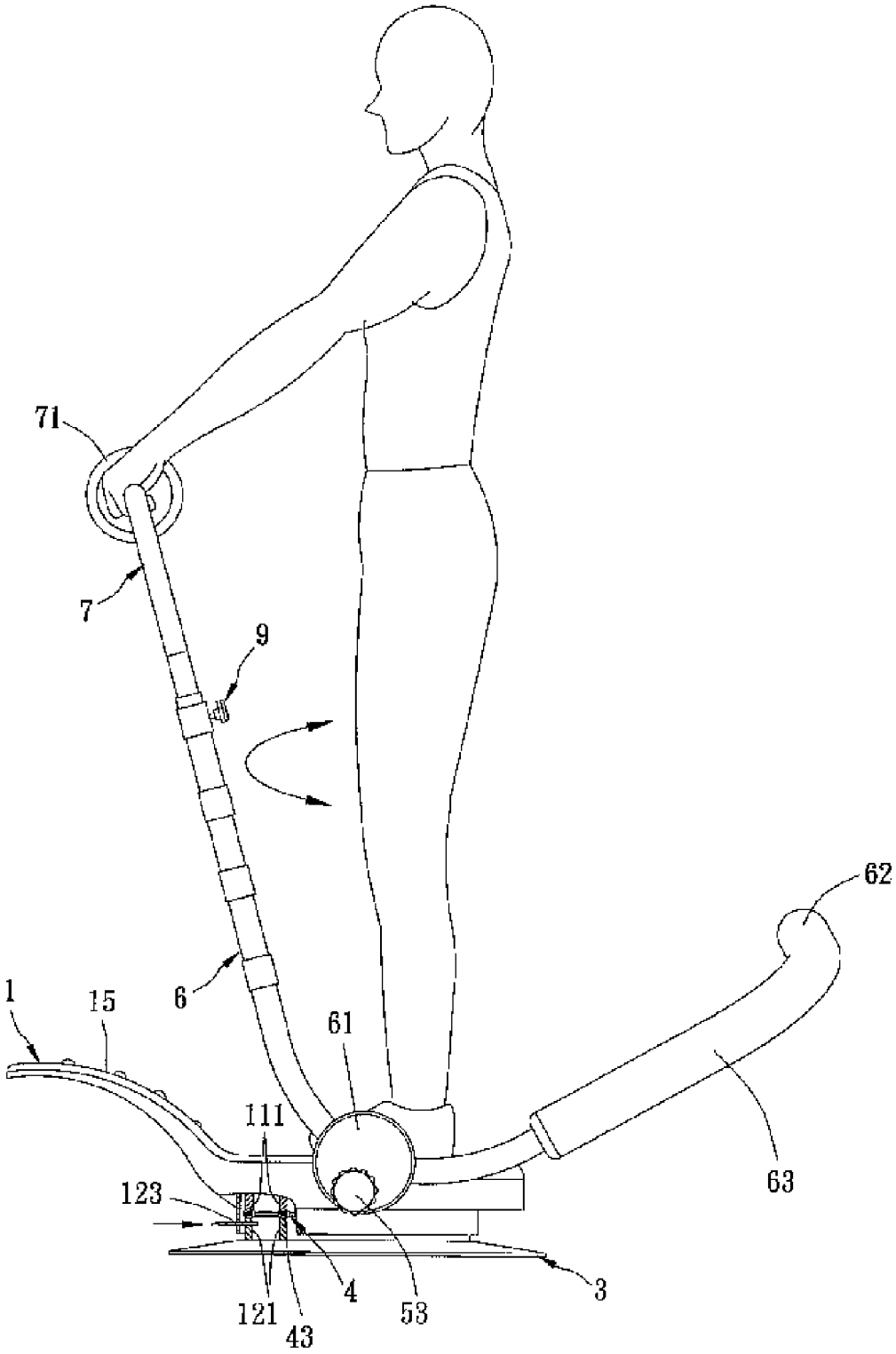
FIG. 10 is an operational side view of practicing waist-twisting and hip-swinging exercises with the exerciser in the present invention.
Figure 11:
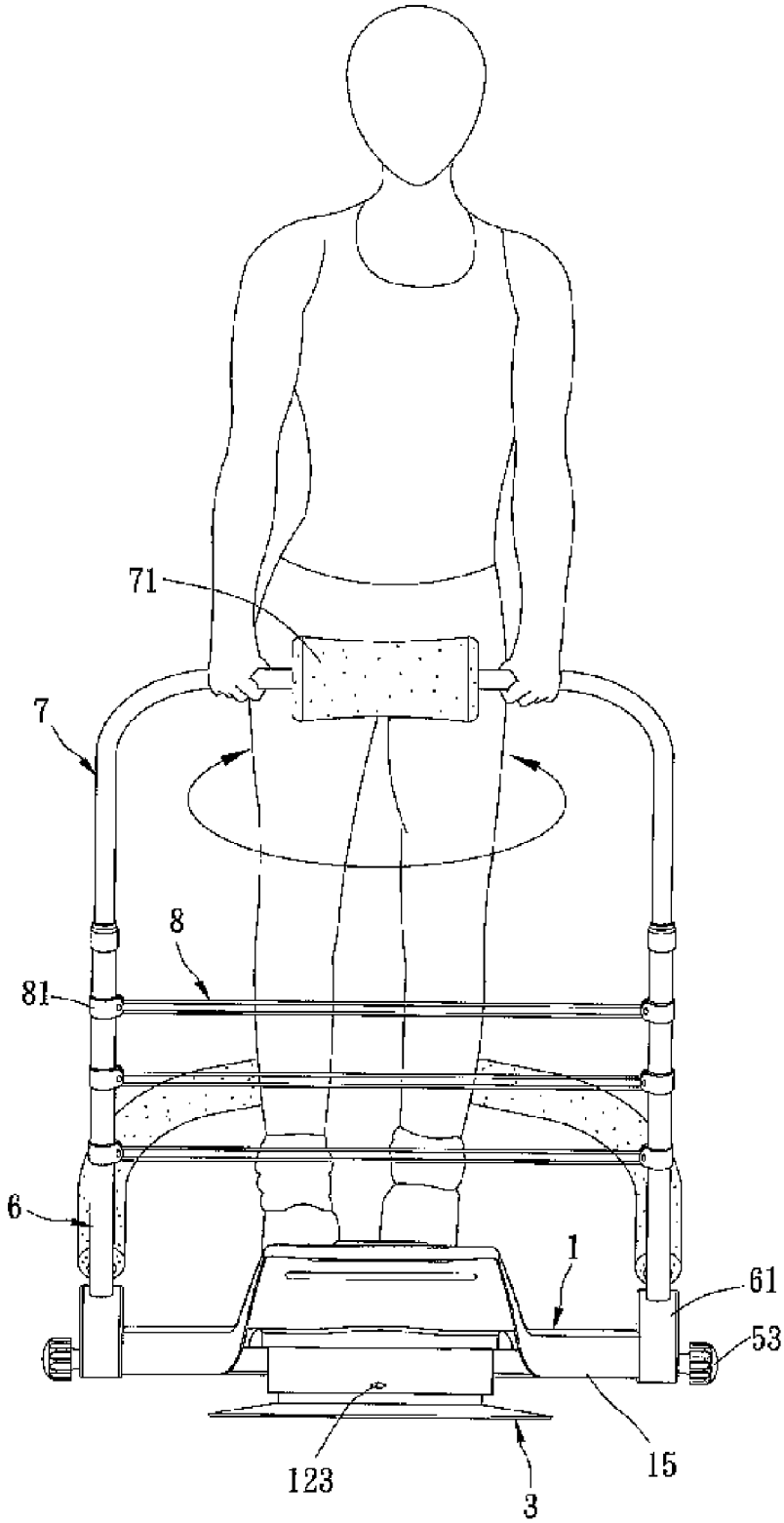
FIG. 11 is another operational front view of practicing the waist-twisting and hip-swinging exercises with the exerciser in the present invention.

With reference to FIGS. 10 and 11, another operation of the exerciser is shown, wherein a pin 123 penetrates the pin hole 122 of the disk recess 12 on the base 1 and the pin hole 322 of the outer circular rib 32 of the bottom rotating disk 3 to keep the base 1 from rotating. After locking the base 1, the user enables to stand on the top rotating disk 2 and to hold middle portion of the supporting frame 7 to twist the waist including the hip and the legs by driving the top rotating disk 2 to rotate. Therefore, the user enables to exercise the lower body in this operation.

Figure 12:
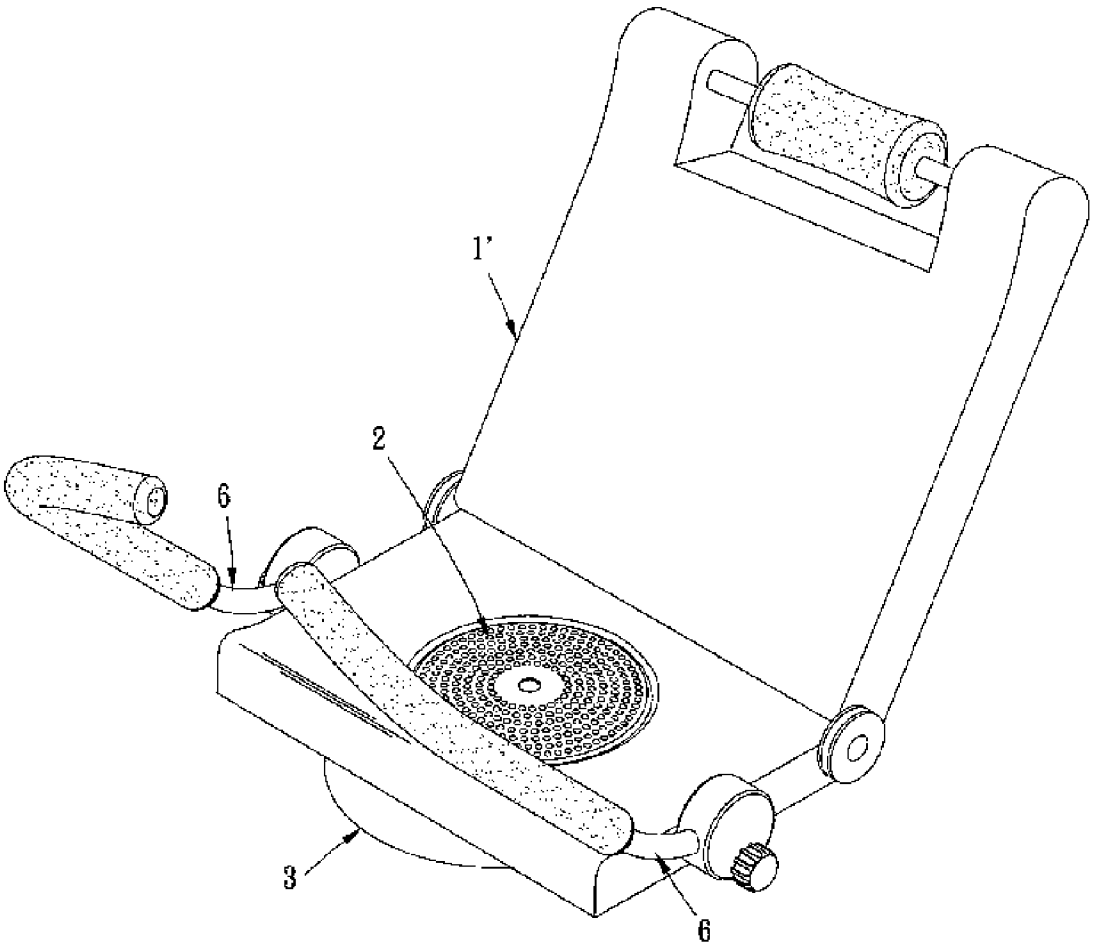
FIG. 12 is a perspective view of another preferred embodiment of a twister and sit-up combination exerciser in accordance with the present invention.

With reference to FIG. 12, another preferred embodiment of the twister and sit-up combination exerciser in the present invention has the similar structure in comparison with the former one except the base 1 is modified to become a chair 1' with an adjustable backrest and the movable lever 6' is simplified to eliminate the rear section. Therefore, the exerciser enables to serve as a normal chair in use.

Figure 13:
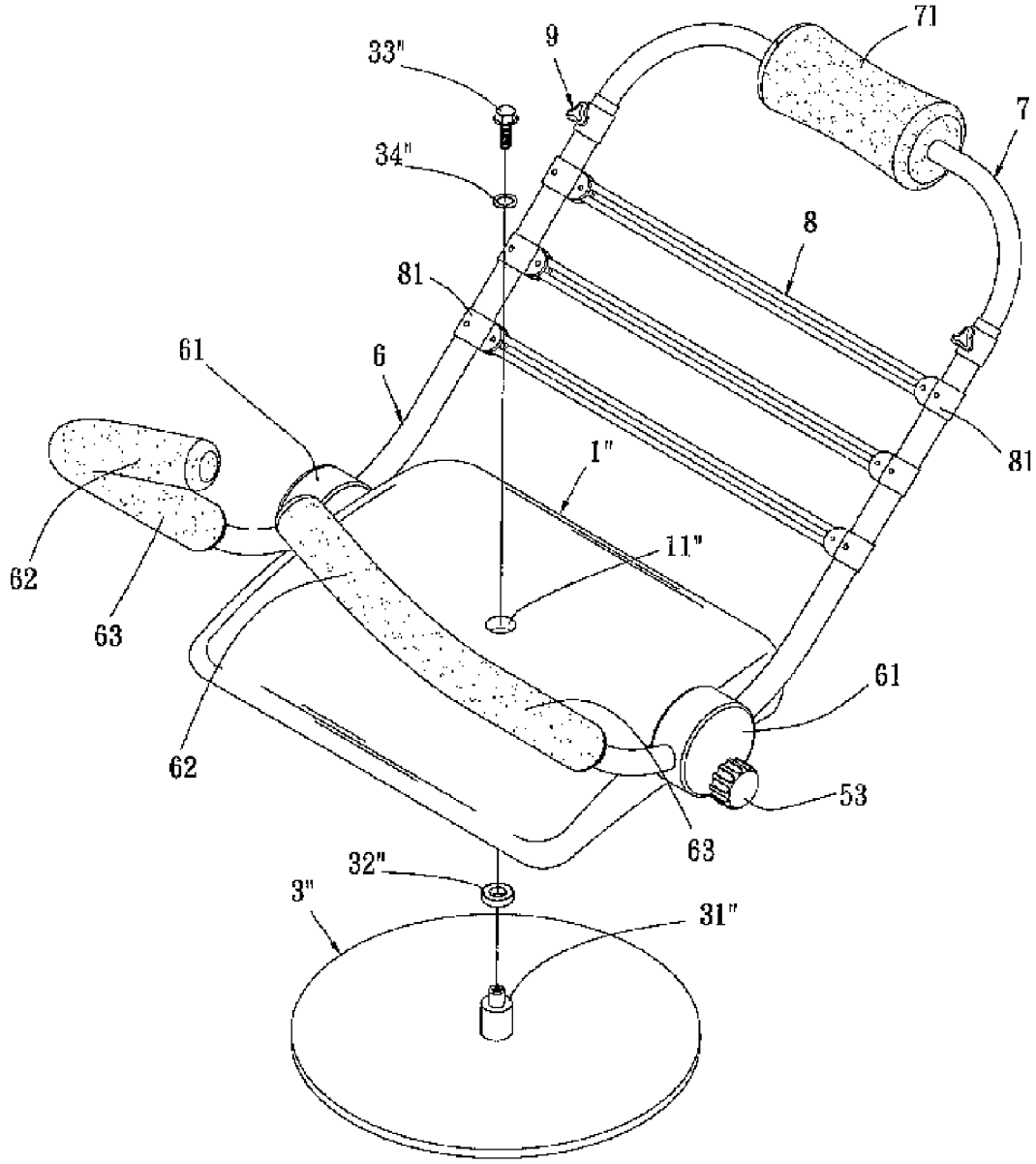
FIG. 13 is an exploded perspective view of still another preferred embodiment of a twister and sit-up combination exerciser in accordance with the present invention.
Figure 14:
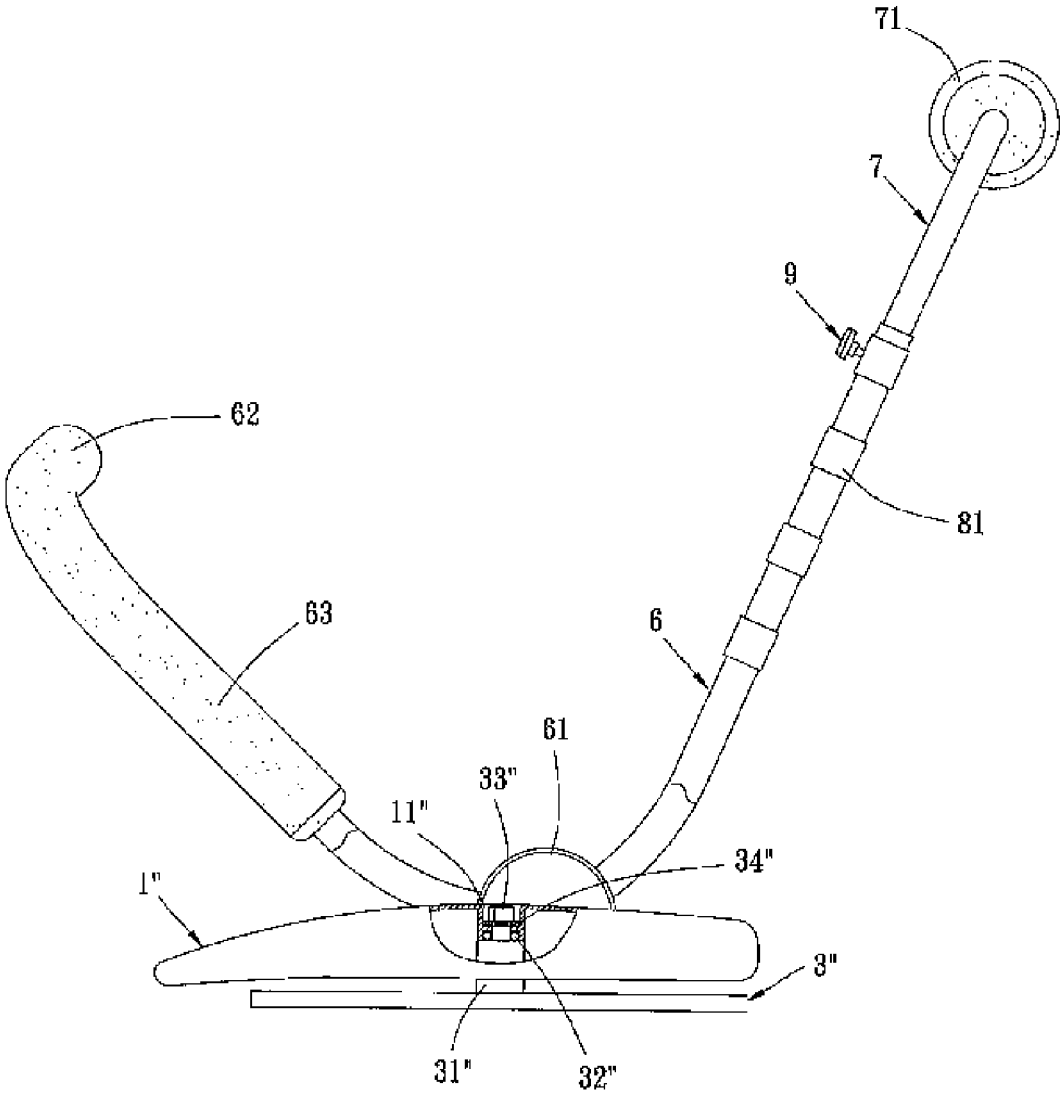
FIG. 14 is a side view of the preferred embodiment of a twister and sit-up combination exerciser in FIG. 13.
Figure 15:
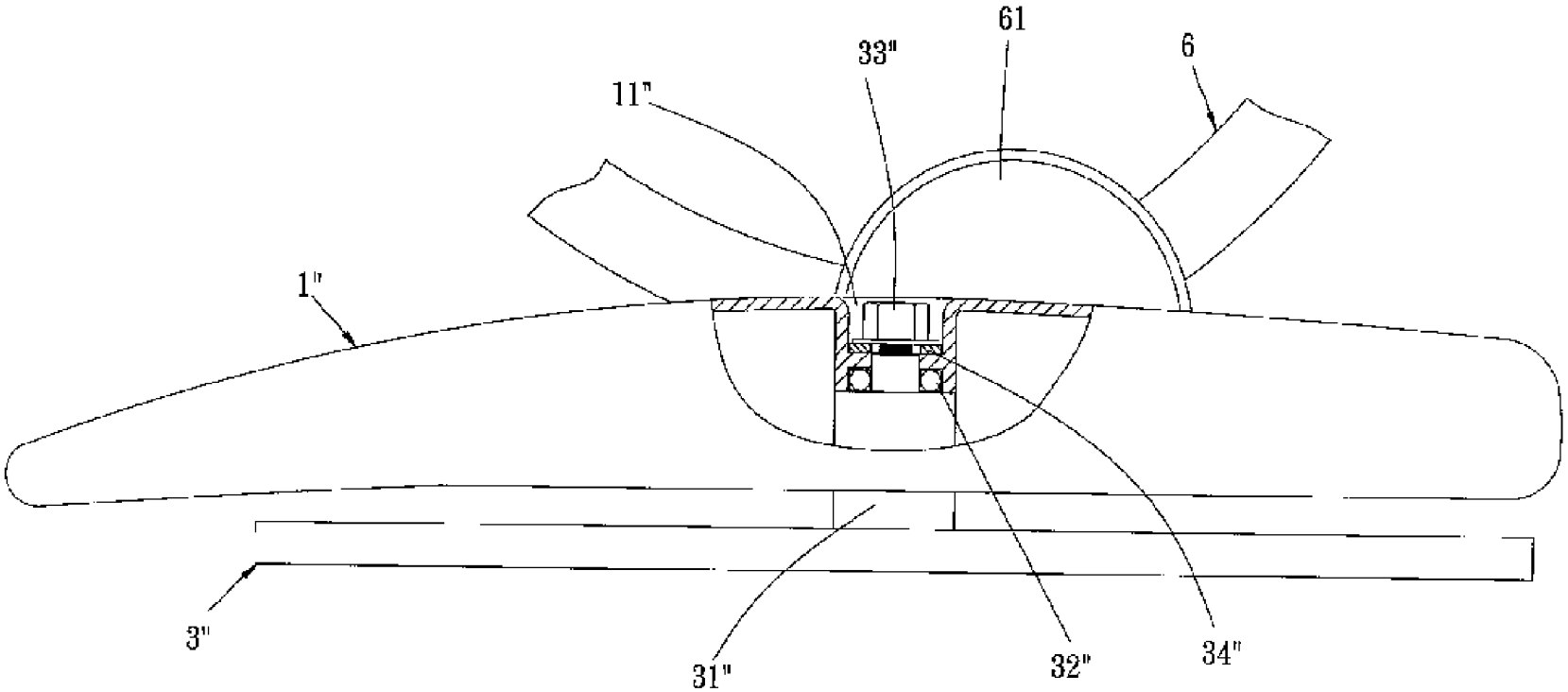
FIG. 15 is a partially cross-sectional side view of the preferred embodiment of a twister and sit-up combination exerciser in FIG. 15.

Still another embodiment of the exerciser in accordance with the present invention is shown in FIGS. 13 to 15. The exerciser has a similar structure in the movable levers 6, the supporting frame 7 and the pivotal assemblies 5 to make the exerciser have sit-up function. Changes are made in the base 1" and the bottom rotating disk 3". The base 1" has a pivotal hole 11" defined in a center of the base 1" to receive a pivotal post 31" with a bearing 32" on the bottom rotating disk 3". When the pivotal post 31" penetrates the pivotal hole 11", a bolt 33" with a washer 34" engages the pivotal post 31" to secure the base 1" on the bottom rotating disk 3". By having the bearing 32", the base 1" can rotate on the bottom rotating disk 3" to serve as a twister for the user.

According to above description, the twister and sit-up combination exerciser in the present invention has the following advantages:

1. Except the sit-up exercise, the exerciser in the present invention also provides body-twisting and waist twisting exercises to make the exerciser versatile and practical in use.

2. The supporting frame 7 can be adjusted by penetrating the locking hole 64 on the movable levers 6 and the corresponding positioning hole 72 on the supporting frame 7 with the locking element 9 to make the backrest have different height to satisfy different users. Therefore, the exerciser is more useful than the conventional one.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A twister and sit-up combination exerciser comprising:

a base;

two V-shaped movable levers pivotally and respectively attached to the base, wherein each V-shaped movable lever has a front section with a grip portion bending inward, a rear section being straight and a joint of the front section and the rear section attached to the base by a pivotal assembly;

a supporting frame being U-shaped, having two arms and telescoping to the rear sections of the two movable levers with the two arms; and at least one twister assembly mounted on the base, wherein the twister assembly comprises an intermediate plate rotatably attached to the base and a rotating disk rotatably clamping the intermediate plate with the base.

2. The twister and sit-up combination exerciser as claimed in claim 1, wherein the base comprises:

at least one disk recess to individually accommodate the at least one twister assembly; and a pin inserting the base and the rotating disk to lock a corresponding one of the at least one twister assembly.

3. The twister and sit-up combination exerciser as claimed in claim 1, wherein the base comprises:

a top face and a bottom face;

two disk recesses respectively defined in the top face and the bottom face, each disk recess having a bottom, a through hole defined in a center of the bottom, two circular ribs concentrically formed on the bottom, wherein each circular rib has a top groove; and two twister assemblies respectively engage the two disk recesses on the base, wherein each rotating disk of each twister assembly has a sunken hole aligning with the through hole on the base, two circular ribs formed on an abutting face adjacent to the corresponding intermediate plate, wherein each circular rib of the rotating disk has a top groove;

wherein each intermediate plate of each twister assembly has an axial hole defined in a center of the intermediate plate and multiple rolling balls rotatably retained on the intermediate plate and clamped by the corresponding circular ribs on the base and on the rotating disk.

4. The twister and sit-up combination exerciser as claimed in claim 3, wherein each intermediate plate further has two circular ribs formed on the intermediate plate;

multiple straight ribs radially formed on the intermediate plate;

wherein the rolling balls are located at intersections of the circular through the base within the circular ribs and the straight ribs.

5. The twister and sit-up combination exerciser as claimed in claim 1, wherein each pivotal assembly comprises:

a sleeve being tubular and having an adjacent end near the base, a tapered rim formed at the adjacent end and a stop flange formed at a middle portion of the sleeve;

a shaft rotatably received inside the sleeve and having a distal end and a threaded hole axially defined in the distal end of the shaft; and a bolt engaged the threaded hole on the shaft.

6. The twister and sit-up combination exerciser as claimed in claim 1, wherein each movable lever has a locking hole defined in the rear section;

wherein, each arm on the supporting frame has multiple positioning holes defined on the arm in a line to selectively align with the corresponding locking hole on the movable lever; and a locking element penetrating the locking hole on the movable lever and the corresponding positioning hole on the supporting to secure the supporting frame.

7. The twister and sit-up combination exerciser as claimed in claim 1, wherein the base is a chair.

8. The twister and sit-up combination exerciser as claimed in claim 1, wherein the supporting frame further has multiple resilient ropes connected between the two arms on the supporting frame.

9. The twister and sit-up combination exerciser as claimed in claim 1, wherein the supporting frame further has a soft cushion attached to a middle section of the supporting frame;

each movable lever has a resilient sleeving body attached to the grip portion.

10. A twister and sit-up combination exerciser comprising:

a base having a pivotal hole;

two V-shaped movable levers pivotally and respectively attached to the base, wherein each V-shaped movable lever has a front section with a grip portion bending inward, a rear section being straight and a joint of the front section and the rear section attached to the base by a pivotal assembly;

a supporting frame being U-shaped, having two arms and telescoping to the rear sections of the two movable levers with the two arms; and a bottom rotating disk rotatably attached under the base and having a pivotal post mounted on the bottom rotating disk to rotatably engage the pivotal hole on the base.

11. The twister and sit-up combination exerciser as claimed in claim 10, wherein the pivotal post has a bearing.

12. The twister and sit-up combination exerciser as claimed in claim 10, wherein the base is a chair.

13. The twister and sit-up combination exerciser as claimed in claim 10, wherein each pivotal assembly comprises:

a sleeve being tubular and having an adjacent end near the base, a tapered rim formed at the adjacent end and a stop flange formed at a middle portion of the sleeve;

a shaft rotatably received inside the sleeve and having a distal end and a threaded hole axially defined in the distal end of the shaft; and a bolt engaged the threaded hole on the shaft.

14. The twister and sit-up combination exerciser as claimed in claim 10, wherein each movable lever has a locking hole defined in the rear section;

wherein each arm on the supporting frame has multiple positioning holes defined on the arm in a line to selectively align with the locking hole on the corresponding movable lever; and a locking element penetrating the locking hole on the movable lever and the corresponding positioning hole on the supporting to secure the supporting frame.

15. The twister and sit-up combination exerciser as claimed in claim 10, wherein the supporting frame further has multiple resilient ropes connected between the two arms on the supporting frame.

16. The twister and sit-up combination exerciser as claimed in claim 10, wherein the supporting frame further has a soft cushion attached to a middle section of the supporting frame;

each movable lever has a resilient sleeving body attached to the grip portion.

* * * * *